United States Patent [19]

Bleich

[11] 4,250,786

[45] Feb. 17, 1981

[54] PUNCHING TOOL

[76] Inventor: Simon Bleich, Gassergasse 29, 1050 Wien, Österreich, Austria

[21] Appl. No.: 960,437

[22] Filed: Nov. 13, 1978

[30] Foreign Application Priority Data

Nov. 14, 1977 [AT] Austria ..... 8106/77

[51] Int. Cl.[3] ..... B26F 1/44

[52] U.S. Cl. ..... 83/691; 83/667; 83/684; 83/698; 83/700

[58] Field of Search ..... 83/652–657, 83/682, 684–691, 620, 622, 698, 700, 697, 694, 923, 667

[56] References Cited

U.S. PATENT DOCUMENTS

| | | | |
|---|---|---|---|
| 38,750 | 6/1863 | Knickerbocker | 83/686 X |
| 109,249 | 11/1870 | Rice | 83/690 |
| 672,323 | 4/1901 | Gentsch | 83/652 |
| 1,411,774 | 4/1922 | Engel . | |
| 2,178,710 | 11/1939 | Valiquette | 83/700 X |
| 2,412,066 | 12/1946 | Shear | 83/689 X |
| 3,517,580 | 6/1970 | Sturm | 83/682 X |

FOREIGN PATENT DOCUMENTS

| | | | |
|---|---|---|---|
| 171260 | 6/1906 | Fed. Rep. of Germany . | |
| 279888 | 3/1914 | Fed. Rep. of Germany | 83/652 |
| 166622 | 7/1921 | United Kingdom . | |

*Primary Examiner*—J. M. Meister

*Attorney, Agent, or Firm*—Fleit & Jacobson

[57] ABSTRACT

A punching tool comprises a plurality of knives, which constitute an annular array and are provided with wedge-shaped cutting edges. Each knife is vertically adjustably secured to a vertical knife holder. Adjacent knife holders are detachably interconnected by a projection of one knife holder and a groove, formed in an adjacent knife holder and by a screw, which extends through a bore in the projection and is screwed in a tapped bore at the bottom of the groove.

14 Claims, 25 Drawing Figures

PUNCHING TOOL

SUMMARY OF INVENTION

A punching tool comprises a plurality of knives, which have wedge-shaped knife edge portions and are vertically adjustably secured to respective knife holders. The knife holders are detachably interconnected so that the knives form an annular array.

This invention relates to a punching tool which consists of elements that are specially designed so that they can be assembled with simple means in any desired configuration and may constitute a shaping tool by which the waste can be cut through so that it cannot adhere to the tool. The invention contemplates the provision of shaping tools used mainly to punch blanks from stacks of sheets and to punch labels and other shaped elements from the blanks.

Punching tools of that kind have previously been made from section strips, which are bent to the desired knife shape by forging and, where an annular punching tool was desired, were welded at the joint between the two ends. This practice has greatly limited the choice of materials, mainly to plain carbon steels (up to 0.4% C), so that the hardness and strength of the knife edges were closely limited and greatly varying and generally only short edge lives were enabled. Such known punching tools do not only require a complicated and expensive manufacture, and the resharpening of their knife edges is complicated and in many cases can be performed only by hand or with copy-grinding machines. In other respects too these tools no longer comply with the requirements of modern punching technology, which call for a precisely defined strength, a consistent strength of the tools even when they have been reground, and an accuracy also of outside dimensions so that the tools are interchangeable without need for fitting work. Besides, each regrinding of the known tools reduces the height and capacity of the tool.

It is an object of the invention to eliminate these disadvantages of the known punching tools. This object is accomplished in accordance with the invention in that the punching tool comprises a knife holder assembly, which consists of a plurality of vertical knife holders, which are detachably interconnected and carry respective vertically adjustable knives, the knife edges of which together constitute a continuous array. This affords the advantage that stacks of the same height can be punched even when the knives have been reground.

According to a further feature of the invention, another knife is provided within the first-mentioned array and has a knife edge which extends from a knife edge of the array to an opposite knife edge thereof, preferably from one corner to a diagonally opposite corner.

Further details of the invention will be explained more fully with reference to the drawings, in which several embodiments of the punching tool are shown by way of example.

FIG. 1 is a side elevation showing a first embodiment of the punching tool;

FIG. 2 a top plan view associated with FIG. 1;

FIG. 3 a side elevation showing a knife holder of the punching tool;

FIG. 4 a side elevation showing a second embodiment of the punching tool;

FIG. 5 a bottom plan view thereof;

FIG. 6 a side elevation showing a knife for use in the knife holder of FIG. 9;

FIG. 7 a top plan view and

FIG. 8 an end view showing the knife of FIG. 6;

FIG. 9 is a perspective view showing a knife holder;

FIG. 10 a side elevation showing the knife holder of FIG. 9;

FIG. 11 a perspective view showing a knife holder which is adjacent to the knife holder of FIG. 9;

FIG. 12 a side elevation showing the knife holder of FIG. 11;

Figure 1:
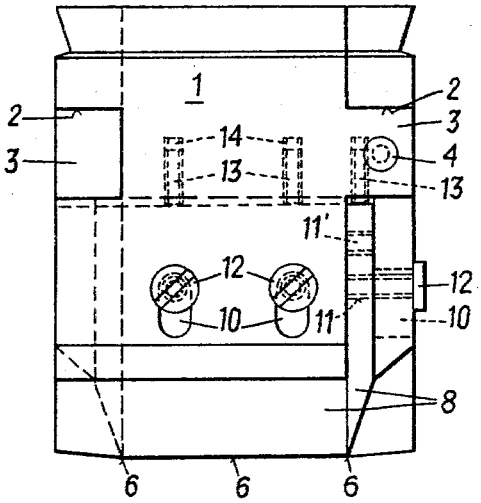
Figure 3:
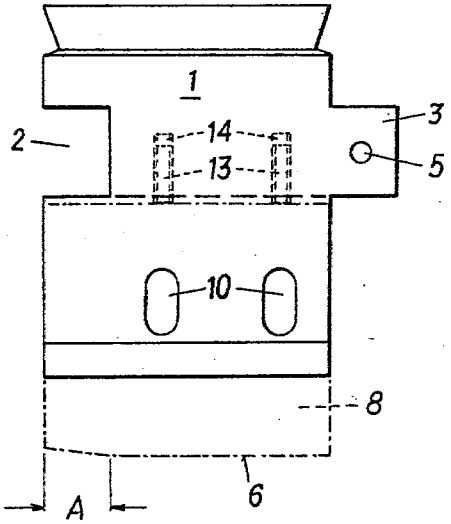
Figure 2:
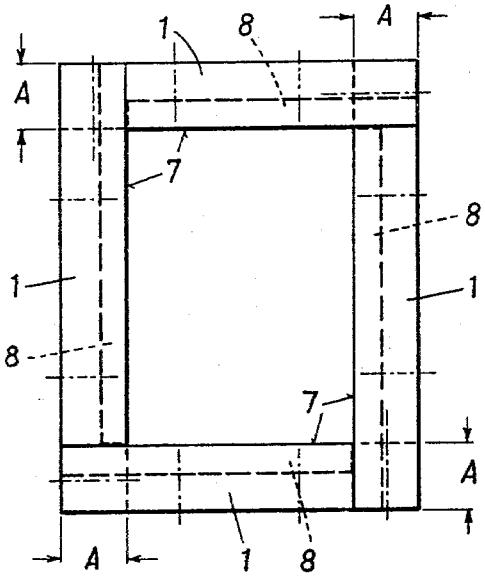

The punching tool shown in FIGS. 1 to 3 serves for blanking simple rectangular blanks and for this purpose comprises a knife holder assembly, which consists of four knife holders 1. Opposite knife holders 1 have the same length. In other respects, all knife holders 1 are identical. The knife holders 1 are assembled at right angles to each other to form a rectangular array. To facilitate the assembling, adjacent knife holders 1 have at their joint-forming edges a groove 2 and a mating projection 3, respectively, which projects into the groove 2. The knife holders are secured to each other by means of screws 4, which are inserted through lateral bores in the projections and screwed into tapped bores in the bottoms of the grooves 2. Each knife holder 1 has a recess 9, in which a knife 8 is fitted, which has a wedge-shaped knife edge portion 6, which on the outside has a ground surface that is inwardly and downwardly inclined toward the inside surface 7 of the knife holder so that these inside surfaces 7 of opposite knife holders 1 are parallel to each other and at each joint between adjacent knives each A-knife edge portion 6 has a part A which is disposed below the groove 2 and extends beyond the end of the adjoining knife edge portion of the adjacent knife. As a result, any frame-shaped waste which may surround the punching tool after a punching operation will be cut into strips by these laterally protruding cutting parts A and these strips can then easily fall down from the punching tool. The protruding part A is preferably upwardly inclined so that the knife can cut into the narrow waste strip without a formation of wrinkles and folds. The provision of a knife edge portion having at its knife edge an inclined surface which extends outwardly and upwardly from the inside to the outside surface of the knife 8, in accordance with the invention, affords the advantage that the knife edge portions 6 can easily be resharpened without a change of the configuration of the punching. Because the punching tools can be taken apart, their knives can be sharpened even with conventional machines and tools and any knives 8 which have been damaged may be individually replaced.

To enable the knives 8 to be fixed to the knife holders 1, each knife holder 1 has two laterally spaced apart, vertically extending slots 10 and each knife 8 has two pairs of vertically spaced apart tapped bores 11, 11'. The tapped bores of each pair 11, 11' register with one of the slots 10. A cap screw 12 is screwed in one of the tapped bores 11, 11' of each pair. At its top, each knife 8 engages two screws 13, which are screwed in tapped bores 14 of the associated knife holders 1 and take up the cutting pressure of the knives 8 and hold the same against an upward movement. The height of the slot 10 may be selected so that the lower bores are initially aligned with the slots 10 and the screws 12 can gradually be shifted downwardly in the slots 10 until the knife 8 has been ground off to such an extent that the cap screw 12 engages the lower end of the slot 10. When this position has been reached, the upper bore 11' will register with the slot 10 so that the cap screw 12 can be inserted into the upper bore 11' to enable a further adjustment of the knife 8.

The edge life of the knives may be prolonged by the use of alloy steels or of cermets.

Each knife holder may be dovetail-shaped at its top end, as shown, for engagement by the tool holder of the punching machine.

Because the punching tools can be assembled from individual parts, another advantage afforded by the present invention resides in the standardization of the knives and knife holders, which can be assembled to form a large number of different punching tools.

Figure 4:
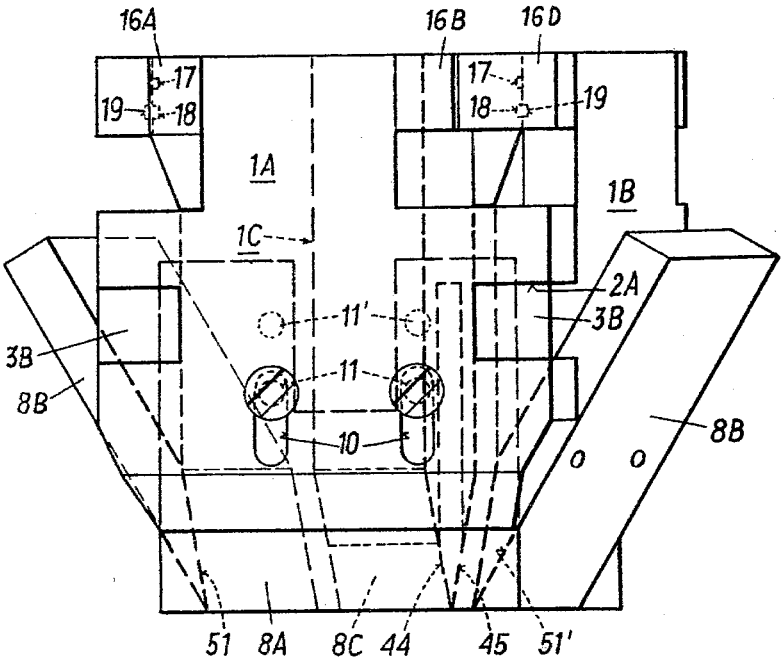
Figure 19:
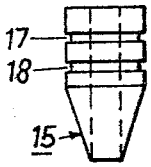
FIGS. 19 and 20 are a front elevation and top plan view showing a curved knife.
Figure 20:
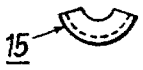
Figure 5:
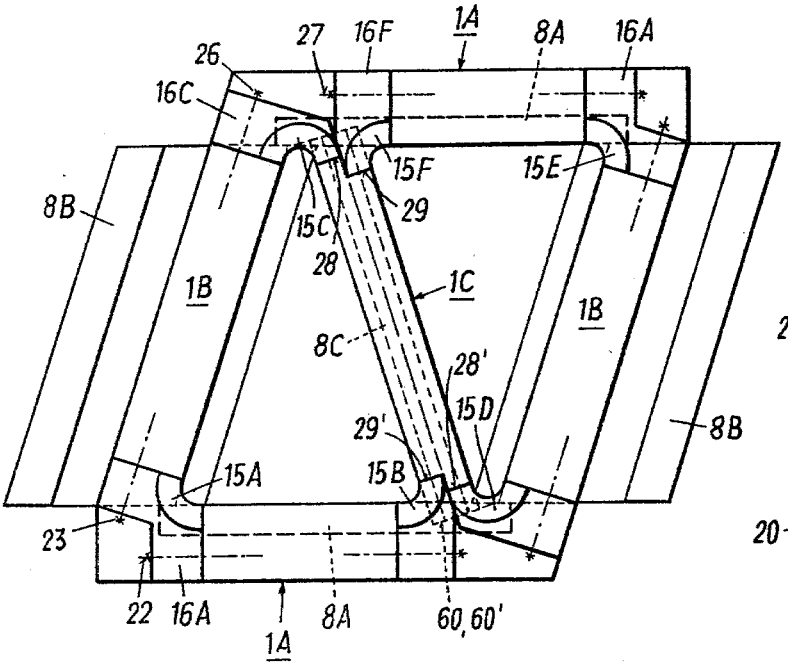
Figure 6:
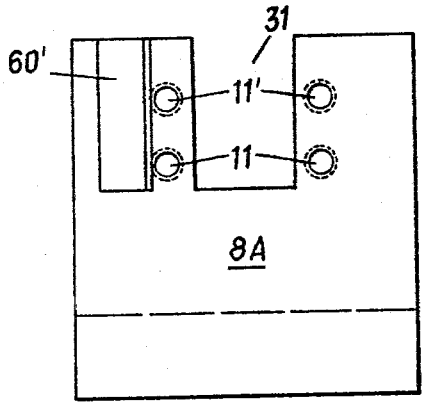
Figure 8:
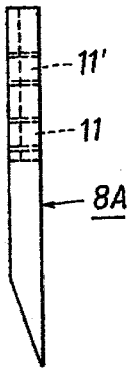
Figure 7:
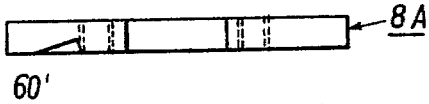
Figure 13:
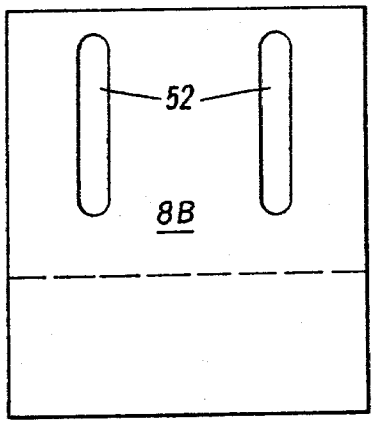
FIGS. 13 and 14 are front and side elevations, respectively, showing the knife for use in the knife holder of FIG. 10.
Figure 14:
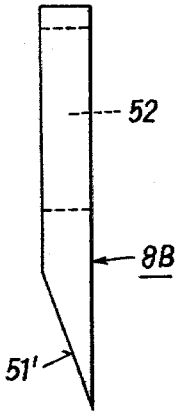
Figure 10:
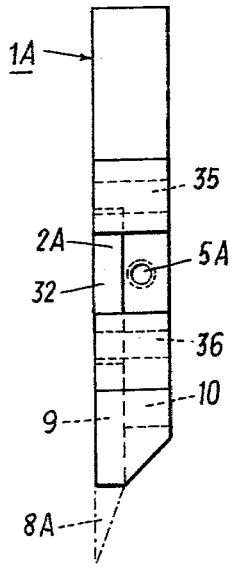
Figure 9:
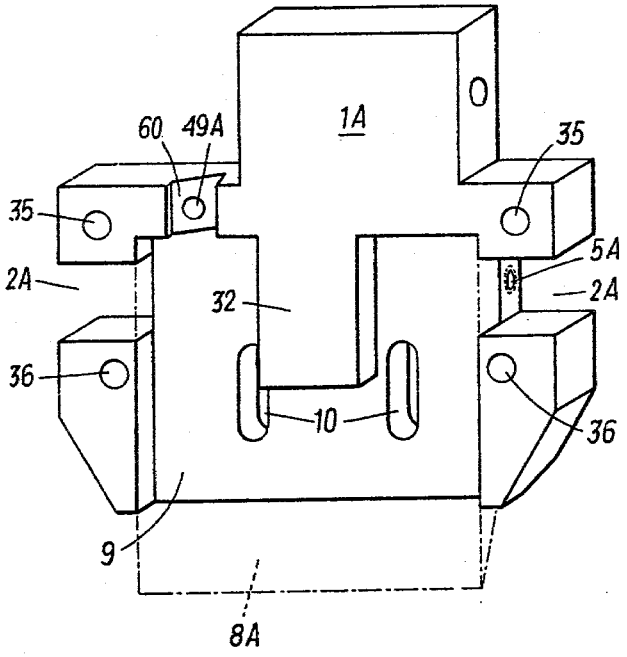
Figure 11:
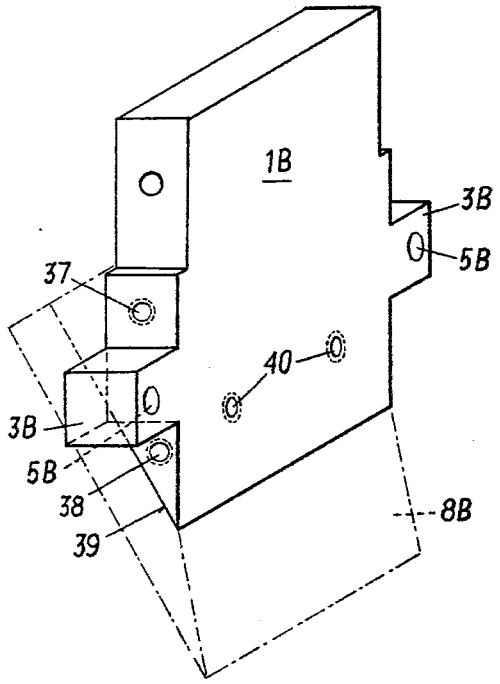
Figure 12:
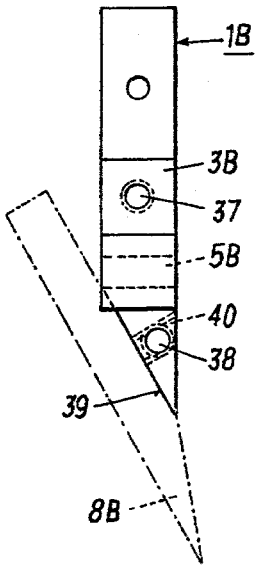
Figure 15:
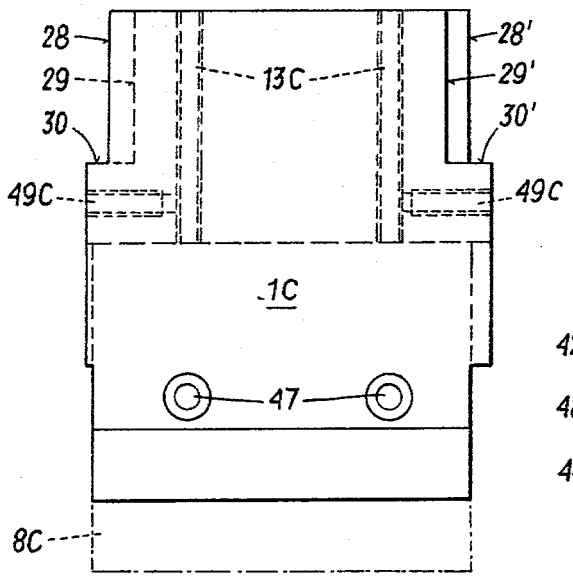
FIGS. 15 and 16 are front and side elevations, respectively, showing another knife holder.
Figure 16:
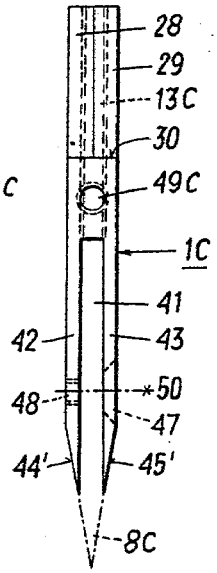
Figure 17:
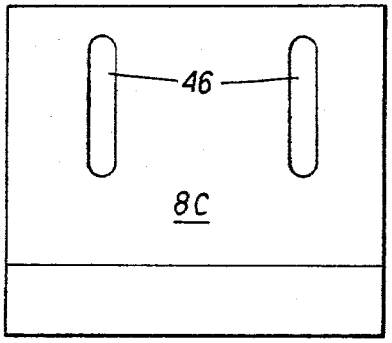
FIGS. 17 and 18 are front and side elevations, respectively, showing the knife for use in the knife holder of FIG. 15.
Figure 18:
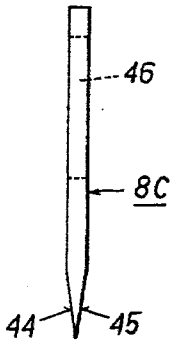

The punching tool shown in FIGS. 4 to 6 comprises knife holders and knives designed for punching out pairs of triangular labels having rounded corners. In the present case, the knife holder assembly consists of two pairs of mutually opposite, identical knife holders 1A and 1B, and a diagonally extending knife holder 1C disposed between the knife holders 1A and 1B. The knife holders 1A are shown in FIGS. 9 and 10 and carry knives 8A as shown in FIGS. 6 to 8. The knife holders 1B are shown in FIGS. 11 and 12 and are provided with knives 8B as shown in FIGS. 13 and 14. The diagonal knife holder is shown in FIGS. 15 and 16 and the associated knife in FIGS. 17 and 18. The joints between knife holders 1A and 1B are similar to the joints between adjacent knife holders 1 of the embodiment described first. Each knife holder 1B is provided at each of its opposite ends with a projection 3B, which is received in a groove 2A of the adjacent knife holder 1A and is secured therein by a screw, that extends through a bore 5B of the projection 3B and is screwed in a tapped hole 5A at the bottom of the groove 2A. Similarly, screws 33, 34 extend through pairs of holes 35, 36, which are provided in each knife holder 1A near opposite ends thereof, and are screwed in corresponding tapped holes 37, 38 of adjacent knife holders 1B. When the knife holders 1A and 1B have been assembled as described, they define a well, which is approximately parallelogram-shaped in cross-section. The knife holder 1C extends along the shorter diagonal of that well so that two well compartments are provided, which are approximately triangular in cross-section and contain curved knives 15, which are disposed at the corners of such compartments at the top thereof and are fixed to the knife holders by clamping elements 16 (see FIGS. 19 to 24). In the present embodiment, six curved knives 15A to 15F are provided. As is shown in FIG. 19, each of these curved knives has two vertically spaced apart peripheral grooves 17, 18, each of which registers with a groove 19 of the associated clamping element 16, depending on the adjusted elevation. When the knife 15 has not yet been reground, the lower groove 18 will register with the groove 19 of the clamping element 16, as shown in FIG. 4, so that a locking element having the shape of a sector of a ring and inserted into both grooves 18, 19 will secure the curved knife 15 in the set position. When the curved knife 15 has been shortened by being reground, the locking element can be removed from the grooves and the curved knife 15 can now be lowered until the groove 17 registers with the groove 19. The locking element can be now inserted into the grooves 17, 19 to lock the curved knife 15 in the associated clamping element 16.

Figure 21:
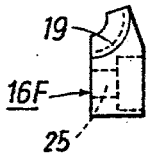
FIGS. 21 and 23 are top plan views showing individual elements for clamping respective curved knives.
Figure 22:
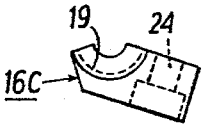
Figure 23:
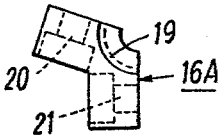
Figure 24:
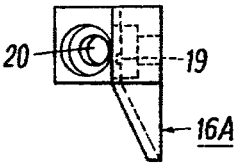
FIG. 24 is a side elevation showing the clamping element of FIG. 23.

As is shown in FIGS. 23, 24, the clamping element 16A associated with the curved knife 15A has bores 20, 21 which receive screws 22, 23. As is indicated in FIG. 5, these screws are screwed in registering tapped holes of the knife holders 1A, 1B. A similar design has been adopted for the diagonally opposite curved knife 15E. The knives 15C and 15F are secured by clamping elements 16C and 16F, which are shown in FIGS. 22 and 21 and have bores 24 and 25, respectively. Screws 26 and 27 extend through the bores 24 and 25 and are screwed in registering tapped holes in the knife holders 1B and 1A, respectively. The same design has also been adopted at the diagonally opposite corner, where the curved knives 15B, 15D, respectively, are provided.

The knife holder 1C has stepped ends formed with offset abutment surfaces 28, 29 and 28', 29', respectively, which are engaged by the curved knives 15C, 15F. These ends are also stepped in height to provide surfaces 30, 30', shown in FIG. 15. These surfaces 30, 30' and the curved knives 15C, 15F and 15B, 15D, respectively, define clearance spaces, through which the waste sections punched out at the corners can flow off freely. The knife holder 1C is held in position by screws, which extend through bores 49A in the knife holders 1A and are screwed in tapped bores 49C of knife holders 1C. Besides, the knife holder 1C is guided in registering grooves 60 of the opposite knife holders 1A and in a continuing groove 60' of the knife 8A.

The knife holders 1A, 1B, 1C are provided with respective knives 8A, 8B, 8C, respectively.

The knife 8A associated with the knife holder 1A is substantially identical to the knives 8 described first, except for the fact that it has no overlength. At the longitudinal center of its top portion, it has a rectangular recess 31, which receives a guide block 32 formed on the knife holder 1A. As in the embodiment described first, the knife 8A is secured by screws which are inserted through slots 10 of the knife holder 1A and screwed into tapped holes 11 or 11', depending on the extent to which the knife has been reground. The screws 13 used in the first embodiment to take up the cutting pressure are provided in this case too for the same purpose.

Like the knife 8, the knife 8A is inserted in a recess 9 on the inside of the knife holder 1A. The knife 8B is mounted on the outside of knife holder 1B, which for this purpose has on its outside an inclined bearing surface 39 and is formed therein with tapped holes 40, which are at right angles to the inclined surface 39 and symmetrical to the longitudinal center line. Fixing screws, not shown, are screwed into said tapped holes 40 and extend through slots 52, which are formed in the knife 8B and register with the holes 40 (FIGS. 13, 14).

The knife 8C of knife holder 1C is fitted in a central recess 41 of the knife holder 1C and has a symmetrical wedge-shaped edge portion that is ground on both sides (FIGS. 15 to 18), whereas the knives 8A and 8B are ground only on one side. The legs 42 and 43 of the knife holder 1C define the slot 41 and at their lower ends have ground inclined surfaces 44', 45', which continue the inclined surfaces 44, 45 of the knife 8C and guide the labels which have been punched out. The knife 8C is formed with two vertical slots 46, which are symmetrical to the longitudinal center line. Screws 50 extend through said slots and are inserted in plain holes 47 of one leg 43 and screwed in tapped holes 48 of the other leg. This arrangement ensures the guiding and fixing of the knife 8C in the knife holder 1C. Screws 13C serve to take up the cutting pressure. The height of the slots 46 determines the extent to which the knives 8C can be reground. The screws 13C must be re-adjusted together with the elevation of the knife 8C so that they engage the latter at its top.

Figure 25:
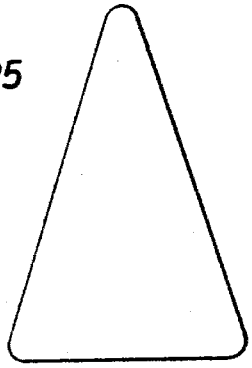
FIG. 25 shows a label which has been punched out with the punching tool shown in FIGS. 4 to 24.

The punching tool described last is used to punch out labels such as are shown in FIG. 25 and used, e.g., for triangular cheese packages. An important feature of the punching tool which has been described resides in that the inclined surfaces 44, 45 at the knife edge of the intermediate knife 8C and are parallel to and face the inclined surfaces 51, 51' at the knife edges of the opposite knives 8B, whereas the two knives 8A, which are at right angles to the knives 8B, have outwardly facing inclined surfaces 52 at their knife edges (FIG. 10). As a result, the blanks which have been punched out by the knives are constrained by the inclined surfaces 51, 44 and 45, 51', respectively, to move apart from each other and upwardly until the labels have reached the top end of the inclined surfaces, and they are then guided vertically upwardly until they reach the knife edges of the curved knives and are cut there to form round corners. As pairs of labels are punched out of stacks of sheets, the production rate is doubled.

What is claimed is:

1. A punching tool comprising a plurality of knives, each of which is provided with a cutting knife edge, an inclined surface extending upwardly and outwardly from the cutting knife edge when the knives are assembled to form a continuous closed array, and a smooth inside surface; and a plurality of detachably interconnected, vertical knife holders to which respective ones of said knives are vertically adjustably fixed in such a manner that the inclined surfaces of the knives are positioned to exert a pressing force on material being punched and the inside surfaces of the knives merge with inside surfaces of the knife holders to define guide surfaces for parts punched from the material.

2. A punching tool as set forth in claim 1, wherein an additional knife is disposed within said array and has a knife edge portion which is ground on both sides to have symmetrical inclined surfaces and which extends from one corner to a diagonally opposite corner of said array, each of those knives which are disposed opposite to said additional knife have at their knife edge an inclined surface which faces and is parallel to the adjacent inclined surface of the knife edge portion of the diagonal knife, and said additional knife is carried by a separate knife holder, which is held by the other knife holders so that four knife holders assembled to form a parallelogram hold a diagonally extending, fifth knife holder.

3. A punching tool as set forth in claim 1, in which adjacent ones of said knife holders are connected by a projection of one knife holder and a groove formed in an adjacent knife holder and receiving said projection and by a screw which extends through a bore in said projection and is screwed in a tapped bore in the bottom of said groove.

4. A punching tool according to claim 1, wherein top faces of said knives engage vertical screws, which are adjustably mounted in the respective knife holders, the knives are held in the respective knife holders by screws which are vertically adjustably fitted in slots of one of said parts and screwed in tapped holes in the other of said parts, and at least two vertically spaced apart tapped holes are provided for selectively receiving the screws for holding the knives.

5. A punching tool as set forth in claim 1, wherein each of said knives is vertically adjustably mounted in a recess on the inside of the associated knife holder and is flush with the inside surface of the knife holder and each knife has a ground inclined surface.

6. A punching tool as set forth in claim 1, wherein curved knives are clamped by clamping elements at the corners formed by the knife holders and have knife edges vertically spaced apart from straight blanking knives.

7. A punching tool as set forth in claim 6, wherein each of said curved knives has two vertically spaced apart grooves, which can be selectively registered with a corresponding groove of the associated clamping element and can be fixed in the set position by a locking member fitted in said registering grooves, and said clamping elements are screw-connected to the knife holders.

8. A punching tool as set forth in claim 2, wherein each of those knives which at their knife edge have an inclined surface that is parallel to the inclined surface of the knife edge portion of the diagonal knife bears on the outside of the associated knife holder at an inclined surface thereof which extends outwardly and upwardly, and said parallel inclined surface extends inwardly and upwardly from the knife edge of said knife.

9. A punching tool as set forth in claim 2, wherein the diagonal knife holder is forked to have two legs and the diagonal knife is fitted between said legs.

10. A punching tool as set forth in claim 2, wherein said diagonal knife holder has end faces which are stepped in width and height to form lateral and downwardly facing engaging surfaces.

11. A punching tool for punching parts out of a stack comprising:

a plurality of knife holders detachably interconnectable to each other to define a continuous closed array having vertically-extending sides;

means for detachably interconnecting said knife holders;

a plurality of knives adjustably connectable to respective ones of said knife holders, said knives having cutting edges positionable below the knife holders, inclined surfaces extending upwardly and outwardly from the cutting edges for pressing a stack being punched, and smooth inside surfaces merging with inside surfaces of said knife holders to define guide surfaces for guiding punched parts; and means for connecting said knives to said knife holders in such a manner that said knives are vertically adjustable with respect to said knife holders.

12. A punching tool as set forth in claim 11, wherein an additional knife is disposed within said array and has a knife edge portion which is ground on both sides to have symmetrical inclined surfaces and which extends from one corner to a diagonally opposite corner of said array, said additional knife being carried by a separate knife holder, which is held by the other knife holders so that four knife holders assembled to form a parallelogram hold a diagonally extending, fifth knife holder.

13. A punching tool as set forth in claim 1, wherein each of said knives is made in one piece.

14. A punching tool as set forth in claim 11, wherein each of said knives is made in one piece.

* * * * *